US007169263B1

(12) United States Patent
Wiljan et al.

(10) Patent No.: US 7,169,263 B1
(45) Date of Patent: Jan. 30, 2007

(54) COARSE DIRT COLLECTOR FOR REMOVING COARSE MATERIAL FROM A PULPER AND CORRESPONDING METHOD

(75) Inventors: Harry Wiljan, Munich (DE); Roland Carra, München (DE)

(73) Assignee: Fea Gesellschaft F. Recycling V.E.U.A.M., Munich (DE)

( * ) Notice: Subject to any disclaimer, the term of this patent is extended or adjusted under 35 U.S.C. 154(b) by 0 days.

(21) Appl. No.: 09/720,879

(22) PCT Filed: Jun. 2, 1999

(86) PCT No.: PCT/EP99/03853

§ 371 (c)(1),
(2), (4) Date: Mar. 26, 2001

(87) PCT Pub. No.: WO00/01878

PCT Pub. Date: Jan. 13, 2000

(30) Foreign Application Priority Data

Jul. 2, 1998 (DE) ..... 198 29 648

(51) Int. Cl.
*D21B 1/32* (2006.01)

(52) U.S. Cl. ..... 162/261; 162/4; 162/48; 162/29; 162/55; 241/39; 241/63; 241/98; 209/156; 209/173; 210/173; 210/523; 414/235; 414/277

(58) Field of Classification Search ..... 162/48, 162/261, 4, 55, 9, 20, 29; 241/14, 20, 21, 241/69, 71, 72, 73, 186.4, 222, 39, 63, 98; 414/235, 277; 209/156, 173; 210/173, 523, 210/532.1

See application file for complete search history.

(56) References Cited

U.S. PATENT DOCUMENTS 5,377,917 A * 1/1995 Wiljan et al. ..... 241/14

(Continued)

FOREIGN PATENT DOCUMENTS

DE 32 25 026 C2 1/1984

(Continued)

*Primary Examiner*—Mark Halpern
(74) *Attorney, Agent, or Firm*—Sughrue Mion, PLLC

(57) ABSTRACT

The invention relates to a coarse dirt collector (7) for removing coarse material from a pulper (1). The coarse dirt collector (7) comprises a support arm (8) with a collecting basket (9). The collecting basket (9) consists of a frame (11) on which tines (Z) are fixed by means of a grid. The coarse dirt collector can be pivoted into and out of the pulper, to which end it moves about an axis of rotation (A) positioned at an angle to the plane that is perpendicular to the longitudinal axis (P) of the pulper. Said angle is between 20° and 40°. The advantage of said device is that the coarse dirt collector (7) has to carry out only one movement between its collecting and unloading position and unloading can take place automatically without need for a special scraping device. Because of the position of the tines (Z) there is no risk of undesirable loss of coarse material prior to unloading. This minimizes the mechanical and control-engineering related complexity of the device provided for by the invention in relation to the prior art and reduces the raking process cycle time. The coarse dirt collector is constructed such that it has as large a capacity as possible for the collection of coarse material. The coarse dirt collector also makes it possible selectively to remove only light-weight coarse material from the pulper.

20 Claims, 2 Drawing Sheets

Figure 1:
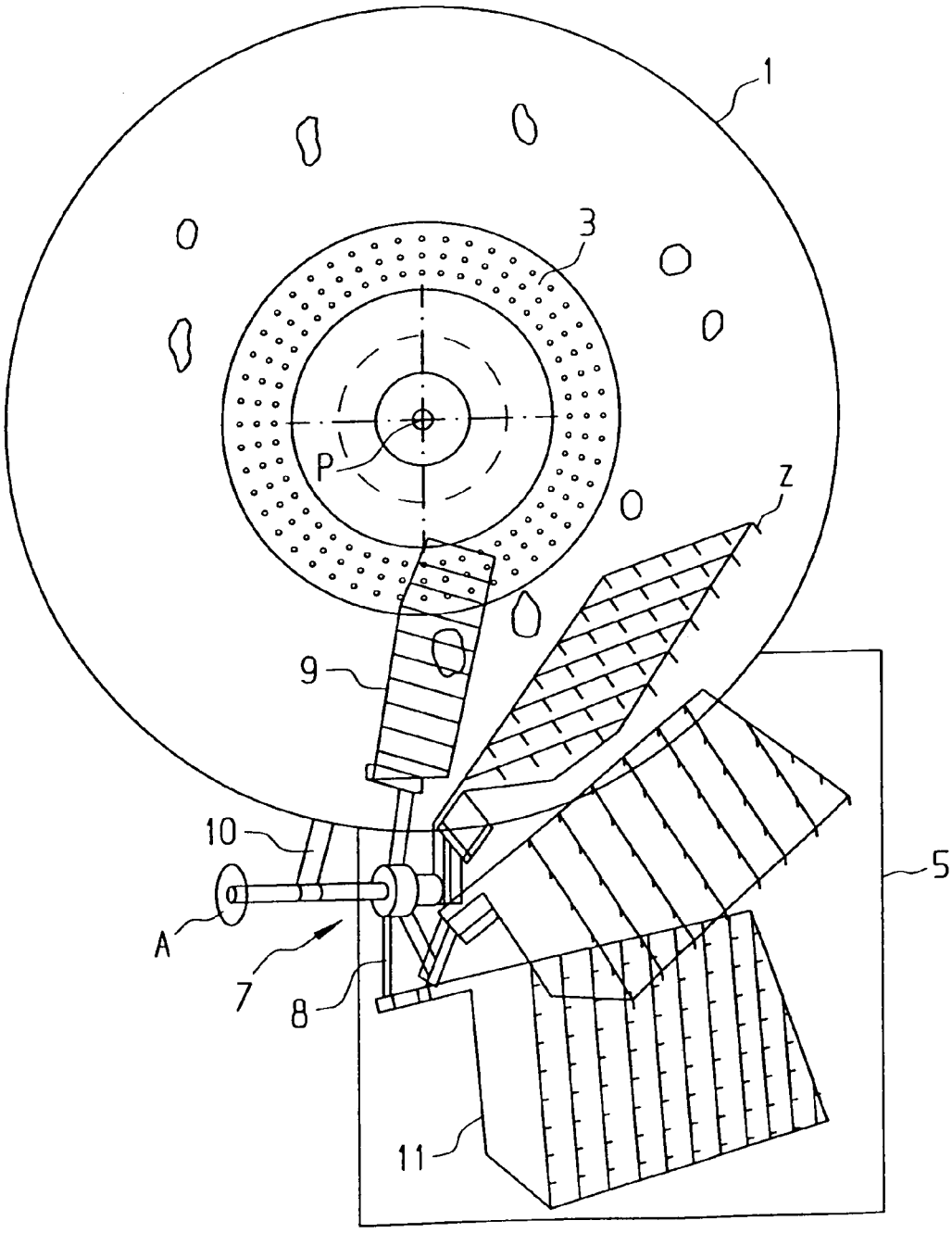

U.S. PATENT DOCUMENTS 6,379,505 B1 * 4/2002 Wiljan et al. ..... 162/261

FOREIGN PATENT DOCUMENTS

DE 44 06 315 A1 9/1995
DE 195 06 084 A1 8/1996
EP 0 520 172 A 12/1992
EP 0 598 187 A 5/1994

* cited by examiner

COARSE DIRT COLLECTOR FOR REMOVING COARSE MATERIAL FROM A PULPER AND CORRESPONDING METHOD

This application is a 371 of PCT/EP99/03853 filed on 2 Jun. 1999.

DESCRIPTION

The invention relates to a coarse dirt collector for removing coarse material from a pulper and to a corresponding working method.

Pulpers, also called material dissolvers, are used for processing material mixtures containing easy to pulp components. A significant field of application relates to the processing of wastes and waste-like materials.

Such a pulper commonly comprises a vessel provided with a rotor. During operation the material mixture to be processed is charged into the vessel together with a liquid, in general water. The rotor is rotated thereby generating strong flow forces. Said flow forces cause the easily pulpable solid materials contained in the pulper to be pulped. Apart from the pulping, partly also a shortening of fibers takes place or, respectively, part of the pulpable materials and other substances contained in the material mixture is dissolved. As the main emphasis of the process, however, lies in the pulping, merely the "pulping" will be discussed herein, while the disintegration and the dissolution taking place parallel to it will not be dealt with separately.

The pulped components of the charged material mixture form a suspension together with the liquid, which can be drawn off from the pulper, for example, by means of a punched screen. Another task likewise consists in somehow removing the non-pulped components (hereinafter also called "coarse materials") from the pulper.

For removing such coarse materials from the pulper coarse dirt collectors are commonly used, which are generally provided with tines. They immerse into the pulper, which contains the coarse materials in a liquid. Said liquid may either be the suspension, or it may be advantageous to draw off the suspension from the pulper first and to remove the coarse materials remaining in the pulper next, for which purpose a liquid, preferably process water, is once again filled into the pulper. The coarse materials floating in the liquid get caught in the coarse dirt collector and are then removed by moving the coarse dirt collector out of the pulper.

A coarse dirt collector is known from DE 32 25 026 C2, which comprises a stand column being rotatable by at least 90°. A support arm is mounted on said stand column so as to be movable in an upward and downward direction, which is provided with a collecting basket having tines at the lower thereof. For collecting the coarse materials the support arm with the collecting basket is moved downwardly into the pulper in a direction vertical to the stand column, so that the collecting basket can immerse into the liquid and can be flown through by the same. The coarse materials floating in the liquid get caught by the tines of the collecting basket, which on the support arm is then moved vertically out of the pulper for removing the coarse materials. For unloading the coarse materials the support arm being in its upper position pivots around the column into an area positioned outside the pulper. The collecting basket then hits a collecting basket catch, which results in the tilting of the basket and thereby in unloading the coarse materials into a provided vessel.

The three different movements to be carried out by the coarse dirt collector (vertical upward and downward movement of the collecting arm, rotation of the collecting arm around the stand column, tilting of the collecting basket) require complex motions, thereby a high mechanical and control-engineering related complexity and also a relatively long cycle time.

Another coarse dirt collector is known from EP 0 598 187 B1. In this case the coarse dirt collector is located in a trough, which is connected to the interior of the pulper. The coarse dirt collector is moved out of the trough into the interior of the pulper by pivoting it about a horizontal axis, and, after the coarse dirt was collected by the tines, is pivoted again out of the pulper. The pivoting angle is thereby so dimensioned that the coarse dirt collector with the coarse materials adherent thereto can be pivoted out far enough to be positioned above the upper edge of the trough. In the final phase the coarse materials are scraped off the coarse dirt collector by means of a special scraping device.

The mechanical and control-engineering related complexity in connection with said device is reduced over the device described in DE 32 25 026 C2. In the second example, too, several movements have, however, to be carried out (pivoting the coarse dirt collector about a horizontal axis, scraping off the coarse materials by means of a special scraping device). Moreover, the coarse dirt collector described in EP 0 598 187 B1 only has a small capacity due to the alignment of the tines, which in the collecting position are positioned essentially vertical. The position of the tines moreover results in that they project far down into the pulper. Thus, in an upward movement they also easily entrain coarse materials that have sunken to the base of the pulper due to their heaviness (hereinafter also called "heavy coarse materials"). It may, however, be an advantage to withdraw by means of the coarse dirt collector merely those coarse materials floating in the liquid due to their smaller specific weight or due to their larger surface (for simplification hereinafter also called "light-weight coarse materials"), as the light-weight coarse materials contain different material group concentrations than the heavy coarse materials and as by the separation of both fractions better chances for the utilization or more adapted disposal possibilities are provided. Therefore, the heavy coarse materials are commonly withdrawn via a heavy material lock.

It is the object of the present invention to further facilitate the mechanics of the coarse dirt collector and to thereby reduce the mechanical and control-engineering related complexity to a minimum and also to reduce the cycle time. The coarse dirt collector is to have a large capacity for collecting the coarse materials at the same time, and is to moreover provide the possibility to selectively withdraw the light coarse materials. The invention is to likewise provide a corresponding working method.

In accordance with the invention said object is provided by the method described in claim 1 and by the coarse dirt collector described in claim 11.

According to the invention a coarse dirt collector is used, which is likewise pivoted into the pulper by rotating it about an axis. Said circular movement is, however, not carried out about a horizontal axis, but about an axis positioned at an angle to the horizontal line. If the axis of the pulper is exceptionally not aligned vertically, the pivoting movement is correspondingly not carried out at an angle to the horizontal line, but at an angle to the plane positioned vertically on the axis of the pulper. This has the effect that the tines provided on the collecting basket are moved into an at least horizontal or rather in a slightly upwardly inclined direction in the final position, when pivoted into the pulper. In this position the coarse materials floating in the liquid can be collected in an ideal manner. In an outward pivoting movement the tines move in a downwardly inclined vertical position in the final position, in which the coarse materials automatically, i.e. without external influence, for instance, by use of a scraping device, fall into a vessel being provided for the collection.

In contrast to the known solutions the coarse dirt collector according to the invention and the corresponding working method, respectively, has the advantage that it has to carry out only one single movement about the mentioned inclined axis of rotation. The mechanical and control-engineering related complexity is thereby minimized over the prior art and the cycle time is shortened.

Furthermore it is advantageous that neither a tilting of the collection basket nor a special scraping device are necessary for removing the coarse materials from the coarse dirt collector.

Also a trough, in which the coarse dirt collector moves, is unnecessary. Such a trough is required, if—like in EP 0 598 187 B1—the tines, which are disposed on the collecting basket of the coarse dirt collector, are in a downwardly inclined position during the collecting phase and also during the major part of the outward pivoting movement. In this case it can be expected during the rotational movement that the collected coarse materials fall off from the tines in an undesired manner, unless an obstacle is provided through the wall of the trough at which the tines move along. The trough is an additional component being subject to wear, the exchange of which incurs costs. Moreover, a locking device is required in the trough, which has to be locked during the pulping process so as to prevent pulpable material from getting caught in the trough without being pulped, which is not desirable.

The respective subclaims describe advantageous embodiments and improvements of the method according to claim 1 or respectively of the coarse dirt collector described in claim 11.

Figure 2:
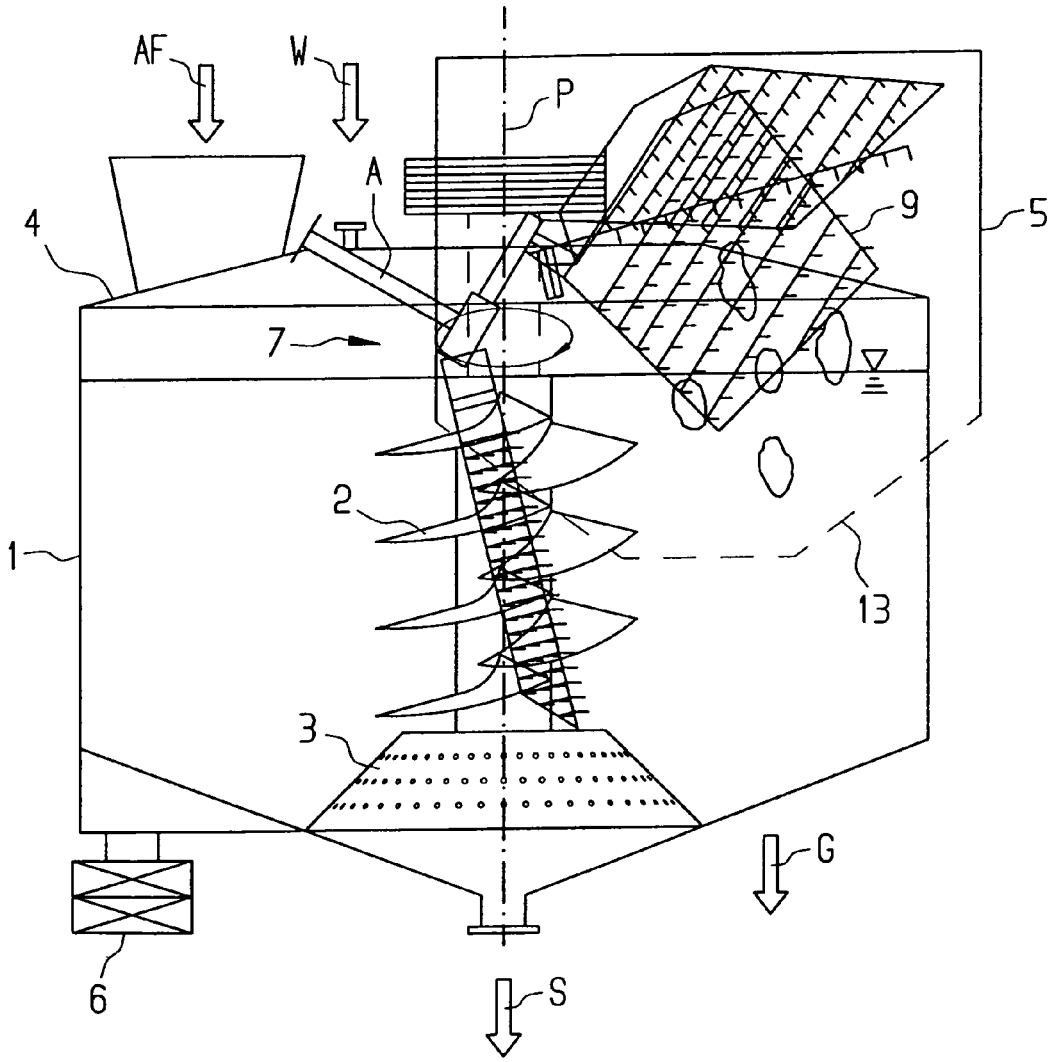

Embodiments of the invention are shown in the drawings and will be explained in more detail in the following description, wherein FIG. 1 shows a schematic illustration of an embodiment of the coarse dirt collector according to the invention in a top view; and FIG. 2 shows a schematic illustration of an embodiment of the coarse dirt collector according to the invention in a lateral view.

FIGS. 1 and 2, on one hand, show the coarse dirt collector in the final position suited for collecting the coarse materials in the pulper and, on the other hand, in the final position suited for unloading said coarse materials.

During the change-over between said two final positions the position of the tines is at first at least horizontal, but rather inclined slightly upwardly. During the outward pivoting movement, which in this case takes place in an upward direction, the tines only reach a downwardly inclined position, when the unloading is to take place. This happens automatically. As long as the collecting basket of the coarse dirt collector is still positioned above the pulper, the position of the tines prevents that the coarse materials are released from the coarse dirt collector in an undesired manner.

The whole coarse dirt collector is constructed in such a way that a maximum collecting capacity is obtained. Due to the at least horizontal, rather slightly upwardly inclined position of the tines in the collecting position, moreover, a selective removal of the light-weight coarse materials is made possible, since a larger screening effect is produced thereby and the tines are positioned further up in the suspension.

A preferred case of application of the described coarse dirt collector relates to the processing of wastes for a biological utilization of individual components. The biologically utilizable components are thereby separated from the biologically non-utilizable components. The biologically utilizable components are easy to pulp in comparison to the other components, which can be pulped only with difficulties or not at all. The formed suspension separated by the punched screen, in which the biologically utilizable components are concentrated, can then be subjected to the biological utilization, while the biologically non-utilizable components remaining in the pulper after the suspension has been withdrawn, i.e. the coarse materials, may be subjected to another appropriate form of utilization.

On the basis of said preferred example of application and of an embodiment of the coarse dirt collector the invention will hereinafter be explained in more detail with reference to the drawings according to FIG. 1 and FIG. 2.

The waste mixture AF is filled into the pulper 1, the axis P of which according to the illustration is in a vertical position. Moreover, water W is added. By rotations of the rotor 2 the waste-water mixture is started to move. A strong toroidal flow is generated, entailing that the biologically utilizable components of the waste mixture are pulped. Said fibers form a suspension together with the liquid present in the pulper, which is drawn off through the punched screen 3 located in the lower part of the pulper. The biologically non-utilizable components of the waste are left behind, which remain largely undestroyed by the flow forces, i.e. the coarse materials.

The pulper is provided with a lid 4 so as to guarantee a sealing effect against the emission of odors. Said lid 4 is provided with an opening for unloading the coarse materials by the coarse dirt collector, to which is joined a hood 5 for the coarse dirt collector in an odor-resistant manner. It is likewise possible to construct the lid of the pulper in a way that the total thereof is opened when the coarse materials are unloaded.

After the suspension S is withdrawn, the pulper is once more filled with a liquid, preferably water W. The heavy coarse materials sink down and can be removed, for instance, via a heavy-weight lock 6. The light-weight coarse materials, which float in the liquid due to their nature, are removed by a coarse dirt collector 7.

Said coarse dirt collector 7 comprises a support arm 8 and a collecting basket 9. The support arm is suspended on the pulper itself by means of a suspension 10, or it is provided with a support construction independent of the pulper. It is rotatably mounted on a shaft. The pivoting region is between 90° and 270°. The collecting basket 9 is fastened on the support arm 8. Said collecting basket 9 comprises a frame 11, in which is located a grid consisting of fixed or variable rods or webs arranged in a grid-shaped or parallel manner. Tines Z are provided vertically to the frame or slightly upwardly inclined. Said tines are attached on the rods or webs either in a stationary or detachable manner (e.g. clamped or screwed), so that particularly the number, length and direction thereof may be varied so as to be able to achieve a possibly high efficiency and variability in view of the different material mixtures. The shape of the support arm is such (bent and/or angled) that the opening provided in the lid of the pulper for the unloading of the coarse materials can be kept as small as possible. Also the frame is fastened on the support arm 8 in a way that it can cope with said task given a maximum raking surface. In addition, the positioning of the frame on the support arm 8 is aligned in a way that it has an optimum collecting position, that it, moreover, can easily pass between the vessel wall of the pulper and the rotor during its movement towards or back from the unloading position, and that the coarse materials do not drop too early.

For the immersion into the coarse dirt-liquid mixture still present in the pulper the support arm of the coarse dirt collector now, for example, carries out a rotational movement of at least 90° and at most 270°, preferably between 150° and 200°. Said rotational movement takes place about an axis A outside the pulper at the upper edge of the cylinder part, which is inclined to the horizontal line, namely preferably by 20° to 40°. Due to said rotational movement the collecting basket completely immerses into the liquid. In the collecting position the frame fills out the surface between the rotor and the outer wall of the pulper as optimal as possible, and is preferably in a position slightly inclined to the vertical line and likewise to the radial line of the pulper axis.

The tines fastened on the frame point slightly upwardly. By this position it is achieved that a possibly large part of the coarse materials floating in the liquid gets caught in the collecting basket when passing through the same. The collecting basket is then lifted out of the pulper by means of the opposite rotational movement of the support arm. The tines thereby move into the horizontal line at first due to the rotation of the support arm, and with an increasing rotational movement in a downward direction after the edge of the pulper is exceeded, with the result that the coarse dirt is automatically unloaded through the opening in the lid of the pulper and through the hood for the coarse dirt collector. The unloading may be supported mechanically by moving the coarse dirt collector against a catch and/or by moving it back jerkily within a short time. The unloading takes place into an unloading funnel 13, which guides the coarse materials into the inlet of a draining device or a transport device. The system pulper, hood for the coarse dirt collector, collecting funnel and subsequently connected aggregate may be encapsulated in an odor-resistant manner so as to be connected to an exhaust air system.

The coarse dirt collector comprises an electrical or hydraulic drive. The control of the coarse dirt collector may be partly or totally automated.

The formed suspension separated by the punched screen, in which the biologically utilizable components are concentrated, can be subjected to the biological utilization (fermentation, composting). The heavy-weight coarse materials largely contain inert materials (pebbles, ceramics, glass, metals, bones), which may be processed or deposited differently. The light-weight coarse materials separated by the coarse dirt collector are mainly composed of plastics, textiles and wood. Due to the concentration of plastics in said fraction the utilization thereof is feasible. Otherwise the materials being of a high thermal value, which are mainly present in the light-weight coarse materials, are suited for combustion. An additional processing of the light-weight coarse materials prior to their utilization or respectively disposal is likewise possible, which may be the drainage and/or disintegration and/or sorting thereof. Also drying and/or a biologically subsequent treatment is conceivable.

Although the present invention was described above on the basis of preferred embodiments, it is not restricted thereto, but may be modified in various ways and manners.

Especially the form of the vessel and the form of the frame and the tines may be optionally selected.

The invention claimed is:

1. Coarse dirt collector apparatus for removing coarse materials from a pulper having a pulper vessel with a vertical axis, said coarse dirt collector, apparatus comprising:

a coarse dirt collector being pivotable into and out of the pulper vessel from a position above the pulper vessel; and a moving means for providing an inward and outward pivoting movement of the coarse dirt collector by a single unitary movement of said coarse dirt collector from a picking up position within the pulper up to a dropping position outside the pulper and back again, wherein said single unitary movement is performed about an axis of rotation positioned at an angle to a plane that is vertical to the vertical axis of the pulper vessel.

2. Coarse dirt collector apparatus according to claim 1, characterized in that said moving means is suspended on the pulper in a rotatable manner.

3. Coarse dirt collector apparatus according to claim 1, characterized in that said moving means comprises a support construction being independent of the pulper, on which it is suspended in a rotatable manner.

4. Coarse dirt collector apparatus according to claim 1, characterized in that said moving means comprises a support arm and said collector comprises a collecting basket attachable thereto.

5. Coarse dirt collector apparatus according to claim 4, characterized in that the collecting basket comprises a frame, in which a grid consisting of grid-shaped or parallel rods being attachable in a variable or fixed manner is located.

6. Coarse dirt collector apparatus according to claim 5, characterized in that tines are provided on the rods of the frame.

7. Coarse dirt collector according to claim 6, characterized in that the tines are positioned vertical to the frame or slightly upwardly inclined thereto in an immersed position.

8. Coarse dirt collector apparatus according to claim 4, characterized in that the support arm of the coarse dirt collector is bent and/or angled in a way that the unloading opening provided in the pulper is as small as possible.

9. Coarse dirt collector apparatus according to claim 5, characterized in that the frame of the coarse dirt collector is fastened on the support arm in a way that it is aligned suitable for collection in an inwardly pivoted position and that said collector is aligned suitable for unloading in an outwardly pivoted position.

10. Coarse dirt collector apparatus according to claim 5, characterized in that the frame of the coarse dirt collector is fastened on the support arm in a way that said collector can be passed along the wall of the pulper vessel and the rotor during the rotational movement so that the unloading opening in the lid of the pulper is as small as possible and that said collector essentially fills out the surface between the rotor and the wall of the pulper vessel in the collecting position.

11. Coarse dirt collector apparatus according to claim 5, characterized in that the frame of the coarse dirt collector is inclined slightly to a vertical line and likewise slightly to a radial line to the axis of the pulper in the collecting position.

12. Coarse dirt collector apparatus according to claim 6, characterized in that the tines are fastened on the rods in a fixed manner.

13. Coarse dirt collector apparatus according to claim 6, characterized in that the tines are fastened on the rods in a detachable manner.

14. Coarse dirt collector apparatus according to claim 1, characterized in that the pulper comprises a lid with an opening for unloading the coarse dirt.

15. Coarse dirt collector apparatus according to claim 14, characterized in that a hood for the coarse dirt collector is joined to the lid of the pulper.

16. Coarse dirt collector apparatus according to claim 14, characterized in that the total lid of the pulper is opened for unloading the coarse materials.

17. Coarse dirt collector apparatus according to claim 1, characterized by a collecting funnel into which the coarse dirt is unloaded.

18. Coarse dirt collector apparatus according to claim 1, characterized in that the moving device is provided with an electrical, pneumatic or hydraulic drive preferably being combined with a spur gear or a toothed rack so as to bring the coarse dirt collector in a linear rotational movement.

19. Coarse dirt collector apparatus according to claim 1, characterized in that the movements of the moving device are wholly or partly automated.

20. Coarse dirt collector apparatus according to claim 1, further comprising a system consisting of a pulper and lid thereof, a hood for the coarse dirt collector and a collecting funnel, wherein said system is sealable in an odor-resistant manner.

* * * * *